US012589914B2

(12) United States Patent
Milbrandt et al.

(10) Patent No.: US 12,589,914 B2
(45) Date of Patent: Mar. 31, 2026

(54) RESILIENT BAG CLOSURE STRIP AND METHOD

(71) Applicant: Bedford Industries, Inc., Worthington, MN (US)

(72) Inventors: Jay A. Milbrandt, Worthington, MN (US); Trevor Wintz, Round Lake, MN (US); Michael Schultz, Worthington, MN (US); David Schiller, Sioux Falls, SD (US)

(73) Assignee: Bedford Industries, Inc., Worthington, MN (US)

( * ) Notice: Subject to any disclaimer, the term of this patent is extended or adjusted under 35 U.S.C. 154(b) by 120 days.

(21) Appl. No.: 18/503,270

(22) Filed: Nov. 7, 2023

(65) Prior Publication Data

US 2024/0150082 A1 May 9, 2024

Related U.S. Application Data

(60) Provisional application No. 63/423,539, filed on Nov. 8, 2022.

(51) Int. Cl.
*B65D 33/16* (2006.01)

(52) U.S. Cl.
CPC ..... *B65D 33/1658* (2013.01)

(58) Field of Classification Search
CPC ..... B65D 33/1658; B65D 33/1675; B65D 33/1691; B65D 33/1625; B65D 33/165
USPC .... 383/84, 89–91, 78, 82, 83; 24/67.3, 67.5, 24/67.9
See application file for complete search history.

(56) References Cited

U.S. PATENT DOCUMENTS 1,067,741 A * 7/1913 Jones ..... B65D 33/30 383/905
1,256,866 A * 2/1918 Bender ..... B42F 9/00 402/19
1,743,509 A 1/1930 Zauner
1,752,464 A 4/1930 Specter
1,979,157 A 10/1934 Higgenbottom
2,138,066 A 11/1938 Matchett
(Continued)

FOREIGN PATENT DOCUMENTS

EP 2072415 A1 6/2009
FR 3055617 A1 3/2018
(Continued)

OTHER PUBLICATIONS

Machine translation of KR-20140002665-U. (Year: 2014).*
International Search Report and Written Opinion for International Appl. No.PCT/US2023/078879 dated Feb. 27, 2024.

*Primary Examiner* — Nathan J Newhouse
(74) *Attorney, Agent, or Firm* — Mai D. Lauer; Westman, Champlin & Koehler, P.A.

(57) ABSTRACT

A reclosure article is configured for permanent attachment to a flexible container. The article includes a resilient, elongated strip including first and second fasteners proximate each of two opposed ends, wherein at least the first fastener includes a slot configured to receive one of first and second opposite side edges of the flexible container. A method is described for closing a flexible container using a reclosure article that is permanently attached to the container. The method includes inserting one of first and second opposite side edges of the flexible container into a slot of the article.

17 Claims, 10 Drawing Sheets

(56) References Cited

U.S. PATENT DOCUMENTS 2,200,313 A * 5/1940 Volksdorf ..... B65D 33/30 383/905
2,528,192 A * 10/1950 Urban ..... A45C 13/10 383/82
2,665,033 A * 1/1954 Robertson ..... B65D 47/2037 383/906
2,854,717 A 10/1958 O'Farrell et al.
3,066,846 A 12/1962 Domigan
3,183,136 A * 5/1965 Purdy ..... B29C 53/04 156/291
3,259,302 A * 7/1966 Rocchisani ..... B65D 33/25 24/30.5 R
3,278,085 A 10/1966 Brown
3,299,927 A 1/1967 Clarizio
3,331,626 A * 7/1967 Kaufman ..... A47G 21/001 294/99.2
3,815,810 A 6/1974 Wellman
4,414,717 A 11/1983 Payne
4,474,383 A * 10/1984 Kikis ..... B42D 9/00 24/336
4,997,104 A 3/1991 Pohl
4,997,149 A * 3/1991 Koch ..... B65F 1/06 220/908
5,222,702 A * 6/1993 Olmos ..... B65B 67/12 248/95
5,743,652 A 4/1998 Dopps
5,931,117 A 8/1999 Lantz et al.
6,098,933 A * 8/2000 Stein ..... B65F 1/1415 D9/434
6,389,652 B1 5/2002 Williams
6,434,796 B1 * 8/2002 Speirs ..... A61M 16/0672 24/336
9,211,989 B2 12/2015 Ahn et al.
9,376,247 B2 6/2016 Dodd
2009/0052811 A1 2/2009 Moreau et al.
2013/0064480 A1 * 3/2013 Verma ..... B65B 7/00 49/34
2018/0007839 A1 1/2018 Wedemeyer

FOREIGN PATENT DOCUMENTS

GB 2503750 B 6/2014
JP 2011078565 A * 4/2011
KR 20140002665 U * 5/2014 ..... B65D 75/58
KR 10-2022-0008452 A 1/2022
KR 102361591 B1 2/2022
NL 8802092 A1 3/1990
WO 2007090303 A1 8/2007
WO 2014061822 A1 4/2014

* cited by examiner

RESILIENT BAG CLOSURE STRIP AND METHOD

CROSS REFERENCE TO RELATED APPLICATIONS

This application claims the benefit of priority from U.S. Provisional Patent Application No. 63/423,539 filed Nov. 8, 2022, which is hereby incorporated by reference in its entirety.

BACKGROUND

Particulate food products and other materials are often contained in flexible bags. It is common for such bags to have reclosure devices to offer ease in handling and so that remaining product in the bag can be contained to prevent spilling. Moreover, reclosing a product bag can prolong the longevity of the contained product by reducing atmospheric (e.g., air, moisture, etc.) ingress and egress through an open top. Ductile, bendable closures such as tin ties, often containing one or more metallic wires with dead fold properties, are known for resealing bags. Such tin ties are described in U.S. Pat. Nos. 1,979,157 and 2,138,066, for example. However, tin ties have drawbacks in some applications.

SUMMARY

In one aspect, a reclosure article is configured for permanent attachment to a flexible container. The article includes a resilient, elongated strip including first and second fasteners proximate each of two opposed ends, wherein at least the first fastener includes a slot configured to receive one of first and second opposite side edges of the flexible container.

In another aspect, a method is described for closing a flexible container using a reclosure article that is permanently attached to the container. The article includes a resilient, elongated strip including first and second fasteners at each of two opposed ends, wherein at least the first fastener includes a slot. The method includes inserting one of first and second opposite side edges of the flexible container into the slot.

This summary is provided to introduce concepts in simplified form that are further described below in the Detailed Description. This summary is not intended to identify key features or essential features of the disclosed or claimed subject matter and is not intended to describe each disclosed embodiment or every implementation of the disclosed or claimed subject matter. Specifically, features disclosed herein with respect to one embodiment may be equally applicable to another. Further, this summary is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure or system elements are referred to by like reference numerals throughout the several views. It is contemplated that all descriptions are applicable to like and analogous structures throughout the several embodiments.

Figure 1:
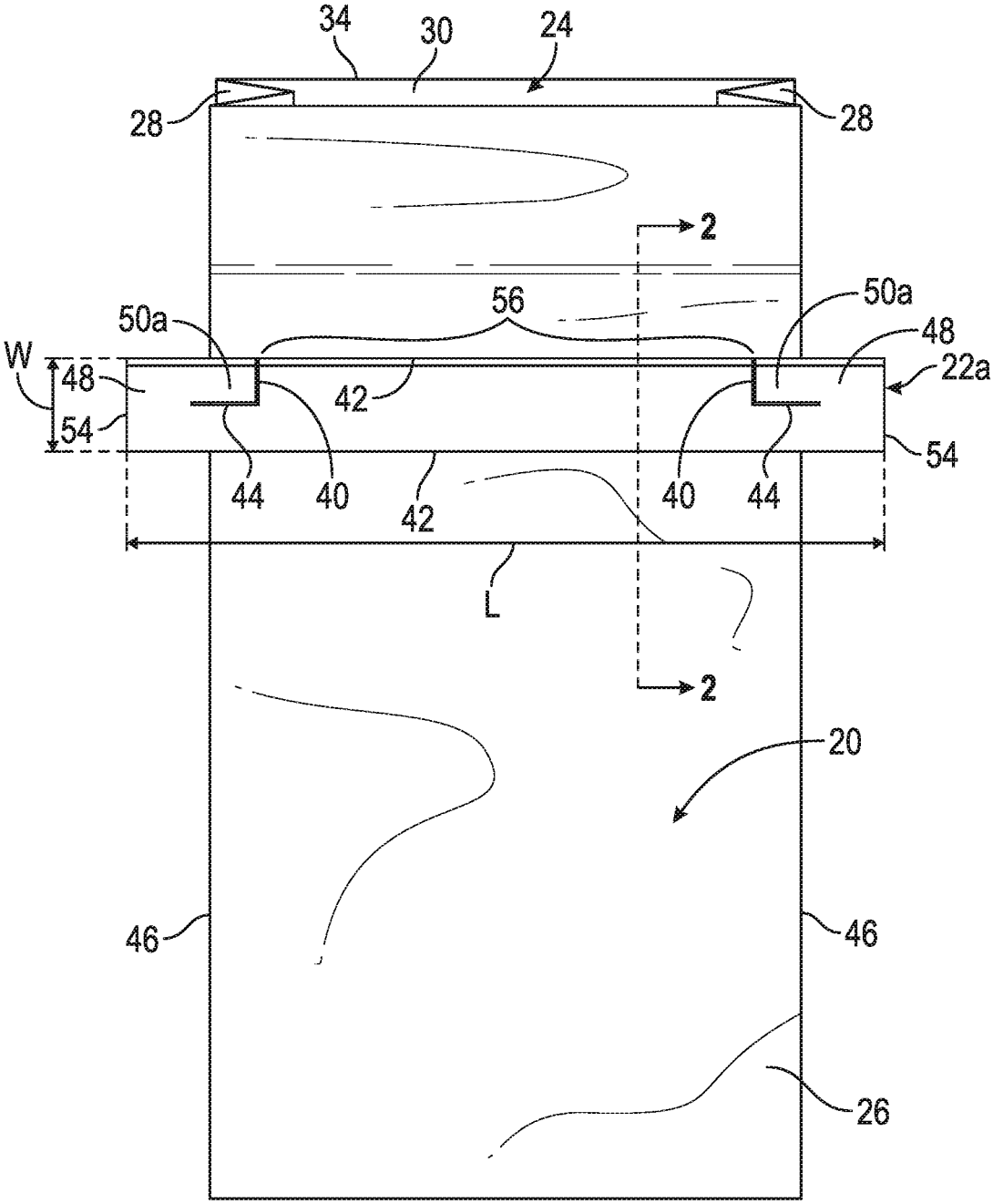
FIG. 1 is a front view of a bag with a first exemplary closure strip attached thereto.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art that fall within the scope of the principles of this disclosure.

The figures may not be drawn to scale. In particular, some features may be enlarged relative to other features for clarity. Moreover, where terms such as above, below, over, under, top, bottom, side, right, left, etc., are used, it is to be understood that they are used only for ease of understanding the description. It is contemplated that structures may be oriented otherwise.

The same or similar reference numerals are used in different figures for the same or similar elements. All descriptions of an element also apply to all other versions of that element unless otherwise stated. The terminology used herein is for the purpose of describing embodiments, and the terminology is not intended to be limiting. Unless indicated otherwise, ordinal numbers (e.g., first, second, third, etc.) are used to distinguish or identify different elements or steps in a group of elements or steps and do not supply a serial or numerical limitation on the elements or steps of the embodiments thereof. For example, "first," "second," and "third" elements or steps need not necessarily appear in that order, and the embodiments thereof need not necessarily be limited to three elements or steps. Unless indicated otherwise, any labels such as "left," "right," "front," "back," "top," "bottom," "forward," "reverse," "clockwise," "counter clockwise," "up," "down," or other similar terms such as "upper," "lower," "aft," "fore," "vertical," "horizontal," "proximal," "distal," "intermediate" and the like are used for convenience and are not intended to imply, for example, any particular fixed location, orientation, or direction. Instead, such labels are used to reflect, for example, relative location, orientation, or directions. The singular forms of "a," "an," and "the" include plural references unless the context clearly dictates otherwise.

DETAILED DESCRIPTION

Figure 2A:
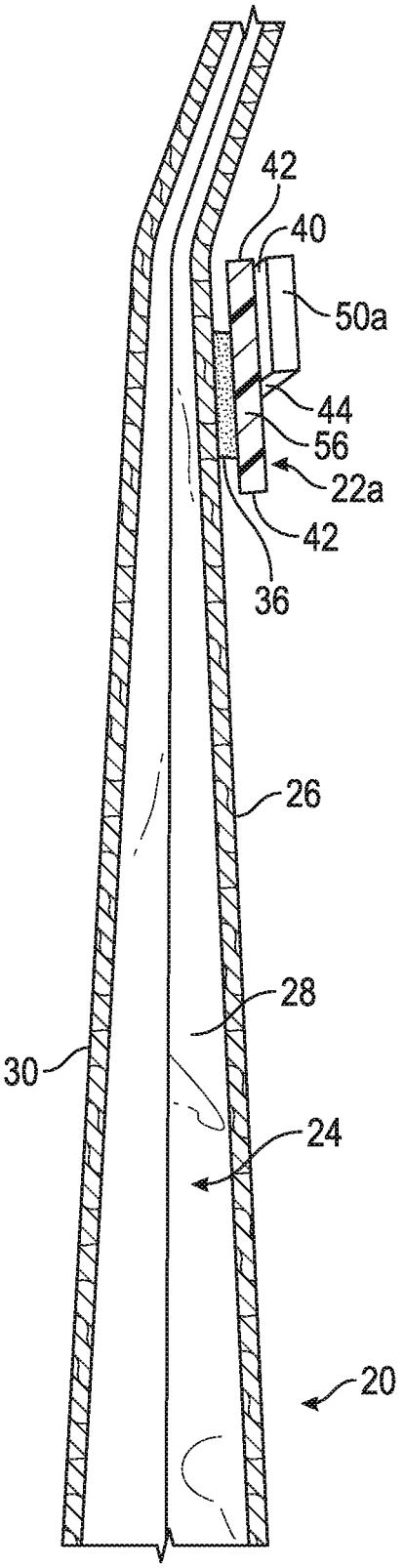
FIG. 2A is a partial cross-sectional view taken along line 2-2 of FIG. 1.
Figure 3:
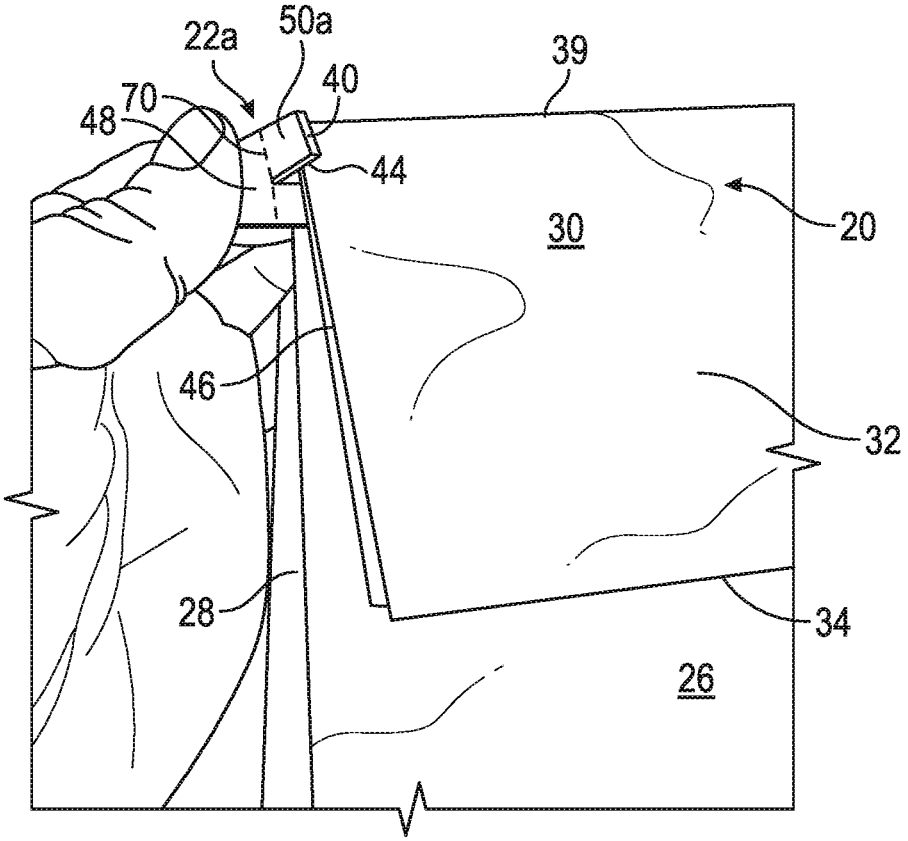
FIG. 3 is a partial front perspective view showing operation of the closure strip to reclose the bag.
Figure 4:
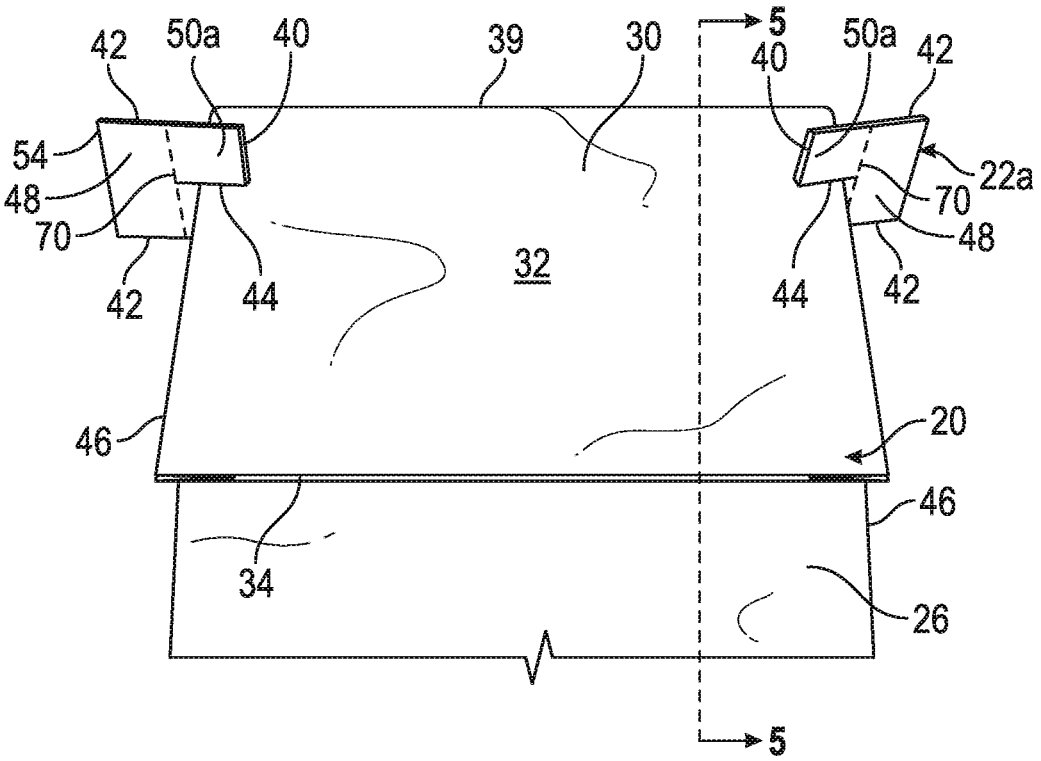
FIG. 4 is a partial front view of the bag with a flap held by the closure strip.
Figure 5:
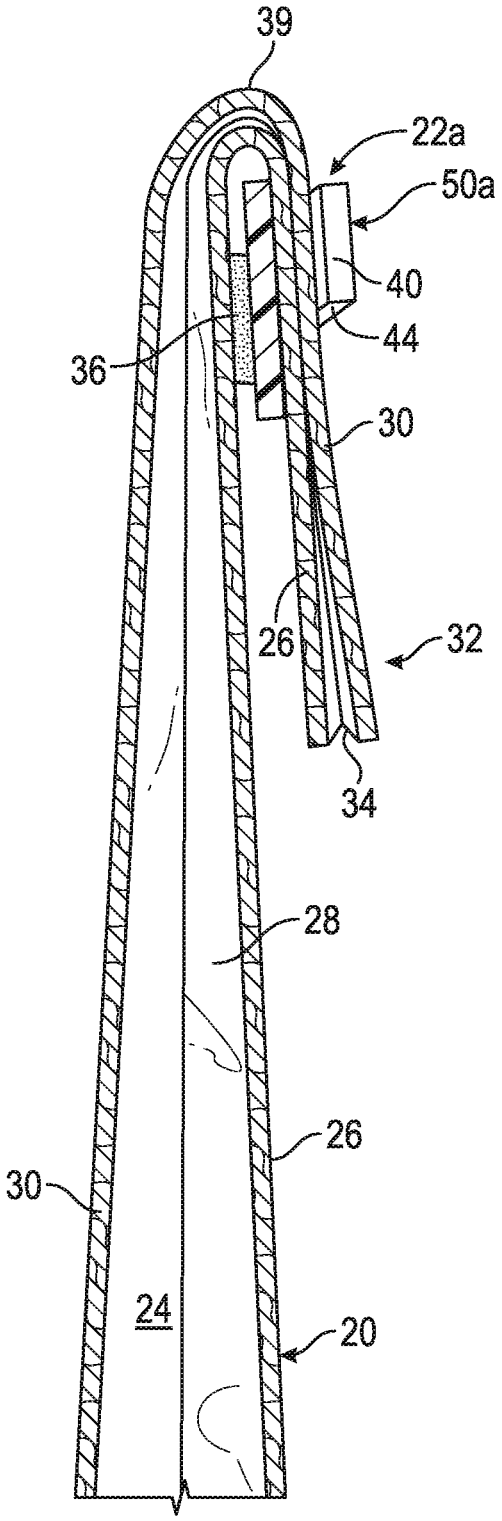
FIG. 5 is a partial cross-sectional view taken along line 5-5 of FIG. 4.

FIG. 1 is a front view of a flexible container configured as a bag 20 having an exemplary embodiment of a closure strip 22 (this particular embodiment is designated 22*a*) attached thereto. As shown in FIGS. 2A and 5, a typical bag 20 has an interior compartment 24 that can be filled with loose particulate material such as coffee beans, ground coffee or other product. Typically, layers of the bag surrounding the interior compartment 24 can be flattened when formed with a front panel 26, pleated side panels 28 and a back panel 30. In a flattened configuration, a folded bag 20 has side edges 46, which are coincident with the side edges of the front and back panels 26, 30. As shown in FIGS. 3-5, the back panel 30 is folded (at fold line 39) over the closure strip 22*a* to form a flap 32 of the bag that lies against front panel 26. As shown in FIG. 3, when flap 32 is folded over closure strip 22, the top edge 34 of bag 20, which forms the opening for accessing the interior compartment 24 of the bag, is located at a bottom of the flap 32. In an exemplary implementation, closure strip 22 has a longitudinal extent (along bisector 68, labeled in FIGS. 6 and 13) that is oriented parallel to top edge 34 of bag 20.

An object of packaging initiatives is to allow for the reuse and recycling of product containers. Many product bags have a polymer construction because of the desirable properties of toughness, durability, acceptance of printing ink, and hermetic properties or water resistance of polymers. However, adding closures including metallic wires or other unlike materials to a container renders it more difficult to recycle that product container. Accordingly, in exemplary embodiments, the described bag closure strip 22 (particular configurations of which are denoted with reference numerals 22*a*, 22*b*, 22*c*, 22*d*, 22*e*) is formed entirely of a recyclable polymeric composition. Moreover, in exemplary embodiments, closure strip 22 has a unitary construction for ease of manufacture and use. In exemplary embodiments, a method of reclosure using the described closure strip 22 does not rely on dead fold properties of a ductile material. Rather, the polymeric material for closure strip 22 is flexible and resilient to allow for bending and recovery of its shape to thereby retain portions of a bag in a desired folded configuration.

Figure 2B:
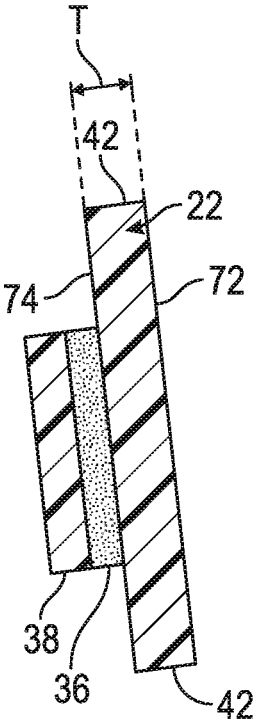
FIG. 2B is a cross-sectional view of a closure strip with an adhesive layer and a release liner.

As shown in FIG. 2A, for all embodiments of closure strip 22, one method of attaching the closure strip 22 to bag 20 is by the use of an adhesive layer 36. In some cases, the adhesive layer 36 is applied to a surface of bag 20, such as front panel 26, during bag manufacture. In other cases, the adhesive layer 36 is applied to the closure strip 22 during manufacture of the closure strip 22. As shown in FIG. 2B, in cases where the bag 20 and closure strip 22 are manufactured separately, a release liner 38 can be disposed on the adhesive layer 36 to protect the adhesive properties of the layer 36 and prevent contamination by dust and debris. In use, the release liner 38 would be removed before pressing adhesive layer 36 onto bag 20, to thereby form a permanent assembly of a bag with a closure strip, as shown in FIGS. 1, 2A, 3-5, 7-12 and 14.

Examples of suitable adhesives for adhesive layer 36 include pressure sensitive adhesives (PSAs) (e.g., hot-melt PSAs), such as those based on acrylic monomers and polymers (e.g., bio-based acrylates), block copolymer rubber adhesives, silicone rubber adhesives, and the like, which may optionally include one or more additional tackifying resins. Release liner 38 is configured to release from adhesive layer 36 so that adhesive remains on the strip 22. In exemplary embodiments, release liner 38 is fabricated from a paper and/or polymeric web (e.g., a polyolefin and/or polyethylene terephthalate web) coated with one or more release agents (e.g., a silicone release coating). A "permanent" attachment of closure strip 22 to bag 20 means that the strip 22 remains attached to the bag 20 for the useful life of the bag 20 and its contents. Thus, there is a convenience factor in its use, as the closure article will not be misplaced, as could occur with a bag clip, rubber band, twist tie, or other separate device, for example.

As shown in FIGS. 3-5, 7, 9, 10, 12 and 14, in some methods of using a reclosure strip 22, the bag 20 is folded at one or more fold lines 39 to close the interior compartment 24 below the fold line 39 and produce a flap 32 that can be inserted through securing features of the closure strip 22. In a case in which bag 20 is folded more than once, such as shown in FIGS. 8-12, more than two layers of the bag 20 are held by securing features of the closure strip 22.

In exemplary embodiments, the securing features of a closure strip 22 are provided proximate each of the two ends of the strip 22. In exemplary embodiments, closure strip 22 is symmetrical in that the securing features on both ends thereof are mirror images of each other. In some cases, as shown in FIGS. 6-14, the closure strip 22 is also symmetrical about a longitudinal bisector 68, so that its shape and function are the same when adhered across a bag 20, whether right-side up or upside-down. However, in other embodiments, closure strip 22 need not be symmetrical.

While particular embodiments of flap securing features on the ends of closure strip 22 are illustrated, it is contemplated that such securing features can be provided in other configurations, including novelty and/or barbed configurations, for example. In exemplary embodiments, closure strip 22 is formed of a stiffly resilient plastic sheet material that allows for deformation in use for ease of insertion of a portion of a bag behind a finger or tab 50 of the strip 22 and removal of the portion of the bag therefrom. The closure strip 22 material should be flexible and pliable but is preferably not elastic, and is therefore dimensionally stable, for most applications. The sheet material for the closure strip 22 also should be somewhat tough in the sense of being sufficiently tear resistant to deter damage to it during storage, transport and display, or by staff or customer handling. Many polymeric materials are suitable.

Those skilled in the art will recognize that any suitable process for the manufacture of closure strips 22 of the disclosure can be employed. Batch processing is useful for limited production runs. Conveyor processing with indexing from station to station for specific operations can be useful, especially for uniquely designed or shaped substrates. In exemplary embodiments, each strip 22 is formed of a unitary piece of material.

As shown in FIG. 1, in one embodiment of closure strip 22*a*, the securing feature in the form of tab 50*a* is provided in the form of a right angle cut including a transverse cut 40 extending from a longitudinal edge 42 of the closure strip 22 and continuing for about half the width of the closure strip 22*a*. Tab 50*a* is also defined by a longitudinal cut 44 extending from the transverse cut 40 and past side edge 46 of the bag 20. A portion of closure strip 22 between tab 50*a* and end edge 54 of strip 22 defines a grip flap 48 that extends beyond each side edge 46 of bag 20. A base 56 of strip 22 is defined between the tabs 50. Typically, the adhesive layer 36 is disposed along a portion of base 56. Thus, it can be seen that a closure strip 22 is configured for use with a particular dimension, especially widthwise, of a bag 20. Thus, while configurations of tabs 50 are particularly illustrated, it is to be understood that variations in dimensions of securing features and of the closure strip itself can be devised according to the particular bag 20 or other application upon which the closure strip 22 is designed to be used.

As shown in FIGS. 3-5, 7, 10, 12 and 14, flap 32 is retained in a folded configuration, with a fold along one or more lines 39. As shown in FIG. 3, a user bends grip flap 48 to move transverse cut 40 out of the plane of base 56, so that flap 32 can slide into longitudinal cut 44. As shown in FIGS. 4 and 5, tab 50*a*, defined by the transverse and longitudinal cuts 40, 44, resiliently bends back toward its original configuration (in which tab 50 is more in plane with base 56 of strip 22) upon the release of pressure on grip flap 48, thereby retaining the flap 32 in the folded configuration. Thus, the tabs 50 do not rely on the deadfold properties of wires as do conventional tin ties; rather, the closure strip 22 retains flap 32 due to inherent structural memory properties of the strip material. In exemplary embodiments, retaining tabs 50 of closure strip 22 extend over side edges 46 of flap 32 to hold the flap 32 against front panel 26.

Of course, the dimensions of a particular closure article 22 will vary, depending on factors including the size of the bag 20 and the strength of holding force desired for flap 32, for example. However, illustrative dimensions are hereby provided. In an exemplary embodiment, article 22*a* has a length L that is at least about 0.75 inch (19 mm) greater than a parallel dimension bag 20 between the opposed side edges 46. For example, for a bag 20 that is 3.5 inches (89 mm) between opposed side edges 46, closure strip 22 suitably has a length L that is about 4.25 inches (108 mm). A suitable width W is about 0.5 inch (13 mm), with a preferred range of about 0.25 inch (6.4 mm) to about 0.50 inch (13 mm). A suitable thickness T is about 0.030 inch (0.76 mm), with a preferred range of about 0.015 inch (0.38 mm) to about 0.060 inch (1.5 mm), depending on a desired flap hold strength. Strip 22 can have flat or profiled major surfaces (front surface 72 and back surface 74). A suitable horizontal cut 44 extends past a respective bag edge 46 by at least about 0.0625 inch (1.588 mm) but is not closer to edge 54 of closure strip than about 0.25 inch (6.4 mm). A length of a suitable horizontal cut 44 is at least about 0.25 inch (6.4 mm) but not greater than about 1 inch (25.4 mm). A suitable transverse cut 40 extends from one longitudinal edge 42 to about half the width W of closure strip 22 but is spaced from the opposed longitudinal edge 42 by at least about 0.0325 inch (0.8 mm).

Figure 6:
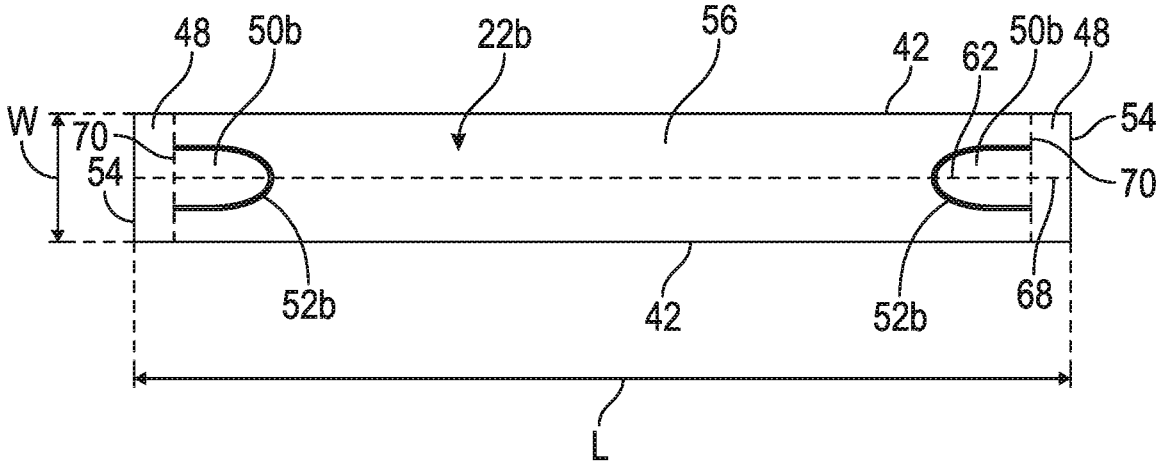
FIG. 6 is a front view of a right end of a second exemplary closure strip.
Figure 7:
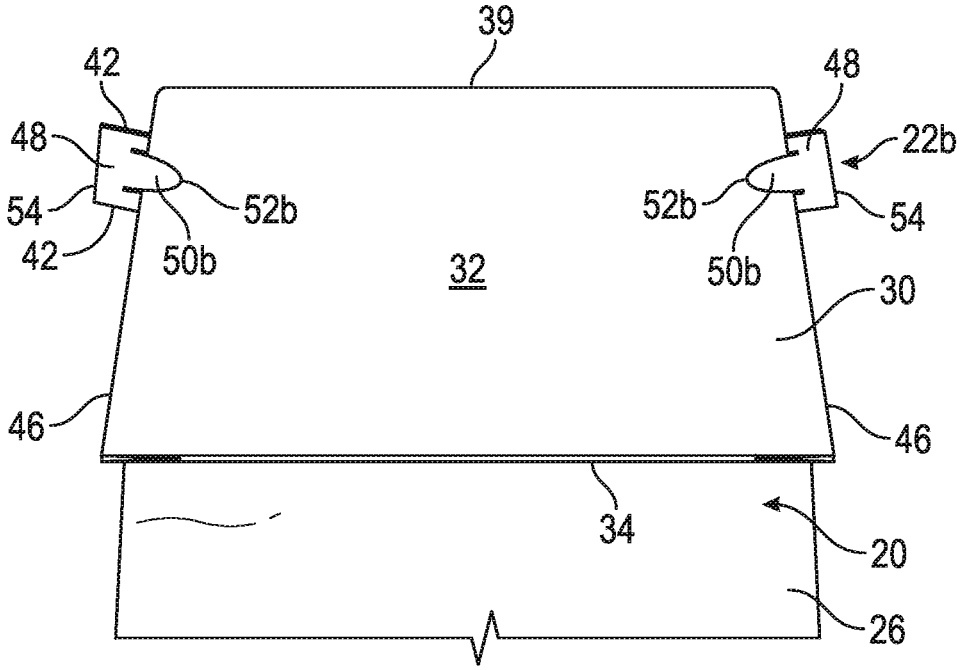
FIG. 7 is a partial front view of a bag closed with the closure strip of FIG. 6.

As shown in FIGS. 6 and 7, in a second embodiment of closure strip 22*b*, the securing feature in the form of tab 50*b* is provided by a curved cut 52*b* that is entirely within an interior of the closure strip 22 (in that the cut 52*b* does not intersect either longitudinal edge 42 or end edge 54 of closure strip 22). A portion of closure strip 22*b* between tab 50*b* and end edge 54 of strip 22*b* defines a grip flap 48 that extends beyond each side edge 46 of bag 20. A base 56 of strip 22*b* is defined between the tabs 50*b*. Typically, an adhesive layer 36 (shown in FIG. 2A) is disposed along a portion of the length of the base 56.

As shown in FIG. 7, flap 32 is retained in the folded configuration, with the fold along line 39. To obtain this closed configuration of bag 20 with closure strip 22*b*, a user bends grip flap 48 to move tab 50*b* out of the plane of base 56, thereby allowing flap 32 to slide into curved cut 52*b* and behind tab 50*b*. Upon the user's release of pressure on grip flap 48, the natural resiliency of tab 50*b* urges it back toward its original configuration (in which tab 50*b* is more in plane with base 56 of strip 22*b*) thereby retaining the flap 32 in the folded configuration. Thus, the tabs 50*b* do not rely on the deadfold properties of wires as do conventional tin ties; rather, the closure strip 22*b* retains flap 32 in place for maintaining the fold of flap 32 due to inherent structural memory properties of the strip material. In exemplary embodiments, retaining tabs 50*b* of closure strip 22 extend over side edges 46 of flap 32 to hold the flap 32 against front panel 26.

Figure 8:
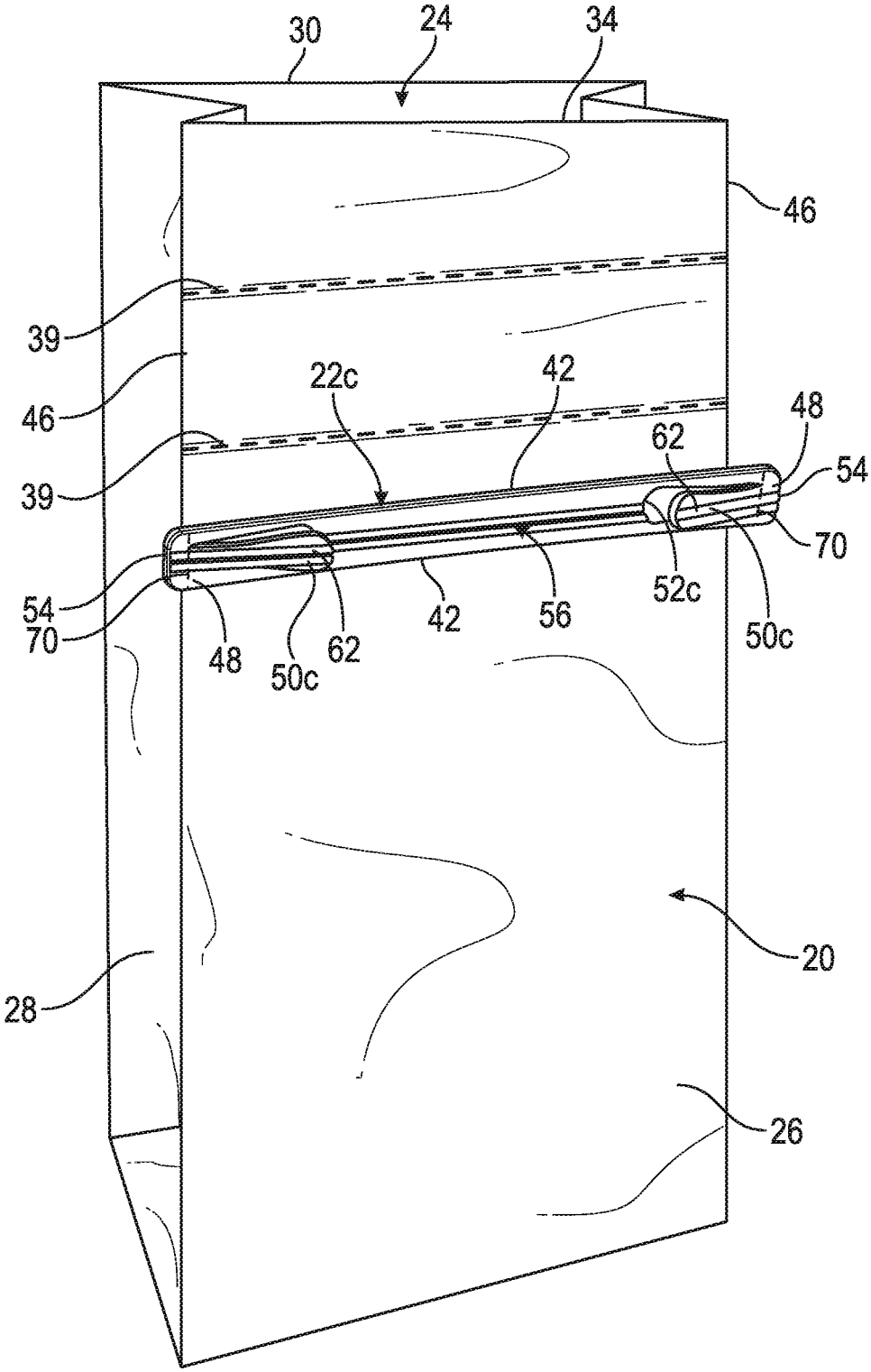
FIG. 8 is a front perspective view of a bag with a third exemplary closure strip attached thereto.
Figure 9:
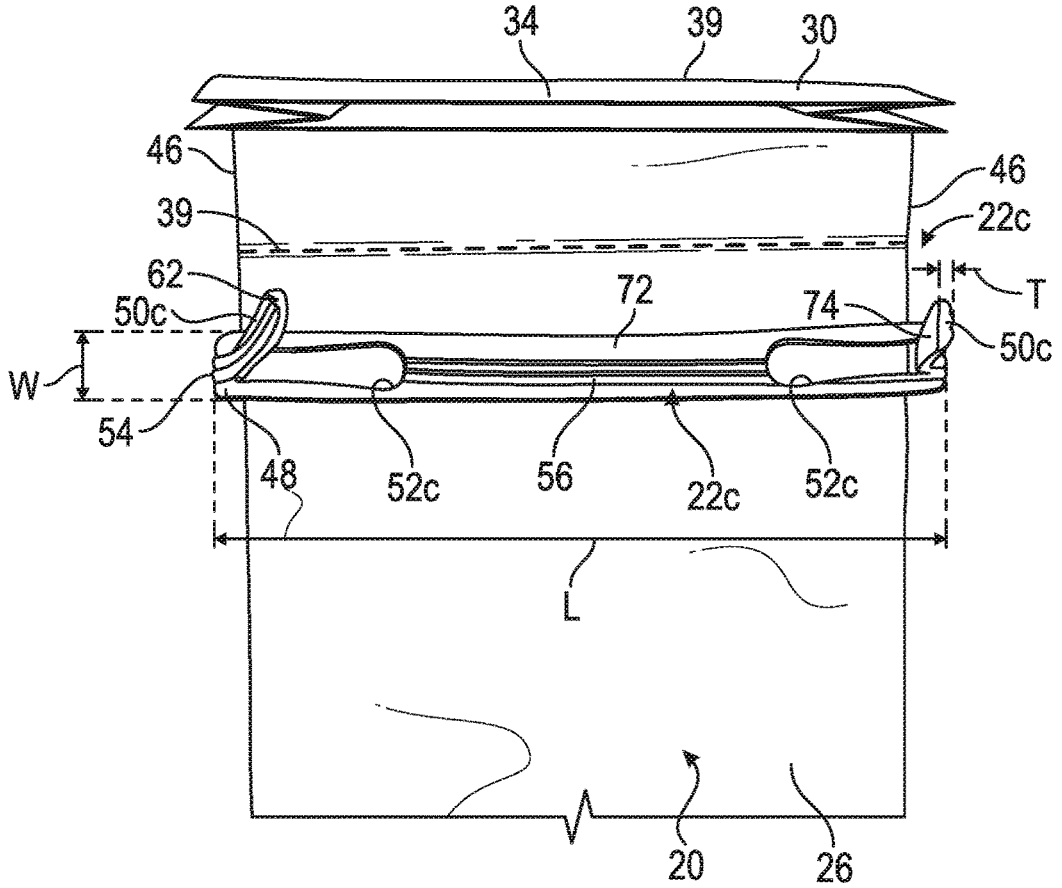
FIG. 9 is a partial front view of the bag with a flap partially folded over and tabs of the third exemplary closure strip raised.
Figure 10:
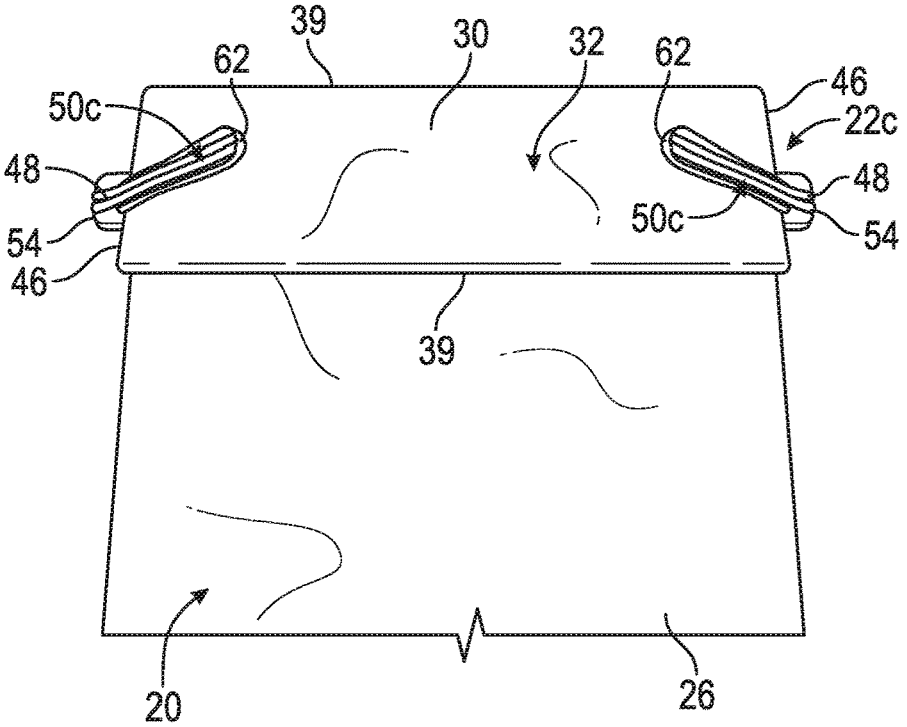
FIG. 10 is a partial front view of the bag with its folded flap held in a closed position with tabs of the third exemplary closure strip.

As shown in FIGS. 8-10, in a third exemplary embodiment of closure strip 22*c*, the securing feature in the form of tab 50*c* is provided by a curved cut 52*c* that is entirely within an interior of the closure strip 22*c* (in that the cut 52*c* does not intersect either longitudinal edge 42 or end edge 54 of closure strip 22*c*). A flexure or hinge line 70 is positioned at the end of the tab 50*c* opposite the separating end 62. A portion of closure strip 22*c* between tab 50*c* (and hinge line 70) and end edge 54 of strip 22*c* defines a grip flap 48 that extends beyond each side edge 46 of bag 20. A base 56 of strip 22*c* is defined between the tabs 50*c*. Typically, an adhesive layer 36 (shown in FIG. 2A) is disposed along a portion of the length of the base 56. In an exemplary embodiment, front surface of strip 22 includes a ridged, ribbed or textured surface for strength, enhanced grip, and aesthetics.

In some methods of use, flap 32 is formed by folding along two fold lines 39. As shown in FIGS. 9 and 10, a user in one method of use lifts each tab 50*c* out of the plane of base 56 and slides flap 32 against curved cuts 52*c* and behind tabs 50*c*. When the tabs 50*c* are bent up, the whole article 22*c* flexes at these hinge lines 70. The hold force for closing the bag 20 is mostly in this area. The plastic material for article 22 is chosen resist bending forces at the hinge lines 70. As shown in FIGS. 8 and 9, providing a thicker profile of material at hinge line 70 results in a greater hold strength of tabs 50. Overall, increasing the thickness and width of the material at the hinge lines 70 will increase the holding force. Depending on the material of closure strip 22 and other factors, the user may manually press tabs 50*c* against flap 32 or permit the natural resiliency of tabs 50*c* to urge them back toward their original configuration (in which tabs 50*c* are more in plane with base 56 of strip 22*c*, though the thickness of flap 32 may prevent a full return to a planar strip configuration). As shown in FIG. 10, closure strip 22*c* thereby retains the flap 32 in the folded configuration, by which bag 20 is closed and its contents sealed within interior compartment 24. In exemplary embodiments, retaining tabs 50*c* of closure strip 22*c* extend over side edges 46 of flap 32 to hold the flap 32 against front panel 26.

In an exemplary embodiment, each tab 50*c* has a rounded elongated bulb shape, wherein a separating end 62 of the tab 50*c* is wider (in a direction perpendicular to the longitudinal extent of strip 22) than the end of tab 50*c* adjacent grip flap 48. The relatively large, smooth curve of cut 52*c* promotes user ease and comfort in lifting tabs 50*c* from base 56, as shown in FIG. 9. However, it is to be understood that a wide variety of shapes for interior cut 52 can be used in the closure strip 22. For example, FIGS. 11 and 12 illustrate a closure strip 22*d* having a more straight-sided interior cut 52*d*.

Figure 11:
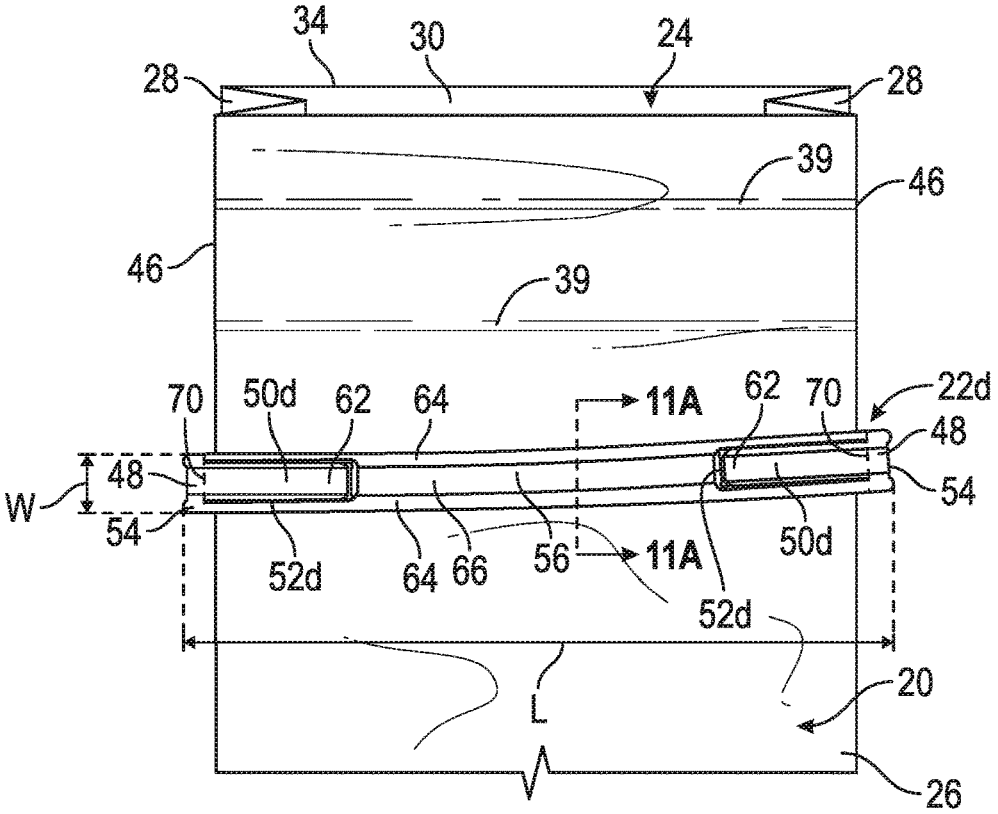
FIG. 11 is a partial front view of a bag with a fourth exemplary closure strip attached thereto.
Figure 12:
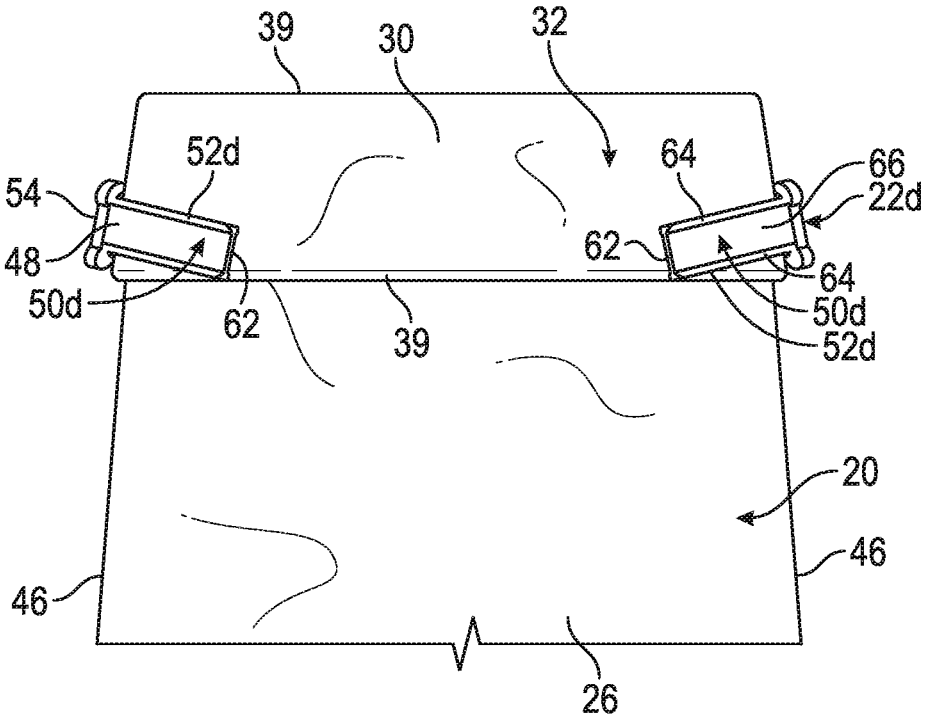
FIG. 12 is a partial front view of a flap of the bag held closed by the tabs of the fourth exemplary closure strip.

As shown in FIGS. 11 and 12, in a fourth exemplary embodiment of closure strip 22*d*, the securing feature in the form of a substantially rectangular tab 50*d* is provided by a cut 52*d* that is entirely within an interior of the closure strip 22*d* (in that the cut 52*d* does not intersect either longitudinal edge 42 or end edge 54 of closure strip 22*d*). A portion of closure strip 22*d* between tab 50*d* and end edge 54 of strip 22*d* defines a grip flap 48 that extends beyond each side edge 46 of bag 20. A base 56 of strip 22*d* is defined between the tabs 50*d*. Typically, an adhesive layer 36 (shown in FIG. 2A) is disposed along a portion of the length of the base 56.

In some methods of use, flap 32 is formed by folding along two fold lines 39. A user in one method of use lifts each tab 50*d* out of the plane of base 56 and slides flap 32 against cuts 52*d* and behind tabs 50*d*. Depending on the material of closure strip 22 and other factors, the user may manually press tabs 50*d* against flap 32 or permit the natural resiliency of tabs 50*d* to urge them back toward their original configuration (in which tabs 50*d* are more in plane with base 56 of strip 22*d*, though the thickness of flap 32 may prevent a full return to a planar strip configuration). As shown in FIG. 12, closure strip 22*d* thereby retains the flap 32 in the folded configuration, by which bag 20 is closed and its contents sealed within interior compartment 24. In exemplary embodiments, retaining tabs 50*d* of closure strip 22*d* extend over side edges 46 of flap 32 to hold the flap 32 against front panel 26.

Figure 11A:
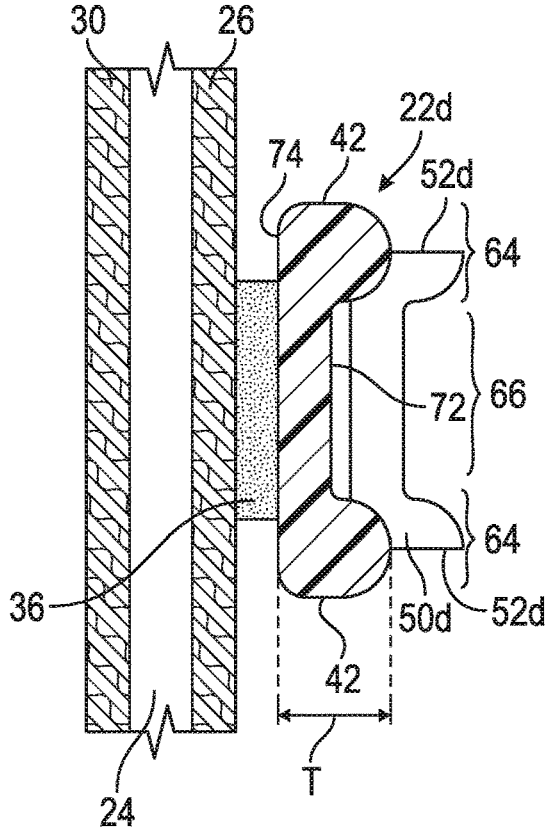
FIG. 11A is a partial cross-sectional view taken along line 11A-11A of FIG. 11.

As shown in FIG. 11A, in an exemplary embodiment, closure strip 22*d* has a cross-sectional shape and dimensions that are reminiscent of a conventional tin tie, in that a raised bead 64 with a rounded top profile is disposed along each of the longitudinal edges 42. In an exemplary embodiment, interior cut 52*d* of each tab 50*d* extends through bead 64 so that a longitudinal edge of teach tab 50*d* has a thicker dimension (and greater strength) than a center lane 66 of the tab 50*d*.

Illustrative dimensions are hereby provided for exemplary articles 22*b*, 22*c*, 22*d*. A suitable length L is at least about 0.25 inch (6.4 mm) greater than a parallel dimension bag 20 between the opposed side edges 46. For example, for a bag 20 that is 3.5 inches (89 mm) between opposed side edges 46, closure strip 22 suitably has a length L that is about 3.75 inches (95 mm). A suitable width W is about 0.31 inch (8 mm), with a preferred range of about 0.25 inch (6.4 mm) to about 0.50 inch (13 mm). A suitable thickness T is about 0.030 inch (0.76 mm), with a preferred range of about 0.015 inch (0.38 mm) to about 0.075 inch (1.9 mm), depending on a desired flap hold strength. Strip 22 can have flat or profiled major surfaces (front surface 72 and back surface 74). A suitable interior cut 52 extends past a respective bag edge 46 by at least about 0.0625 inch (1.588 mm) but is not closer to edge 54 of closure strip than about 0.125 inch (3.2 mm). A length of tab 50 that overlaps bag 20 is at least about 0.25 inch (6.4 mm) but not greater than about 1 inch (25.4 mm). A suitable width of tab 50 is about 0.25 inch (6.4 mm) and is at least about 0.125 inch (3.2 mm) and is spaced from each longitudinal edge 42 by at least about 0.0325 inch (0.8 mm).

Figure 13:
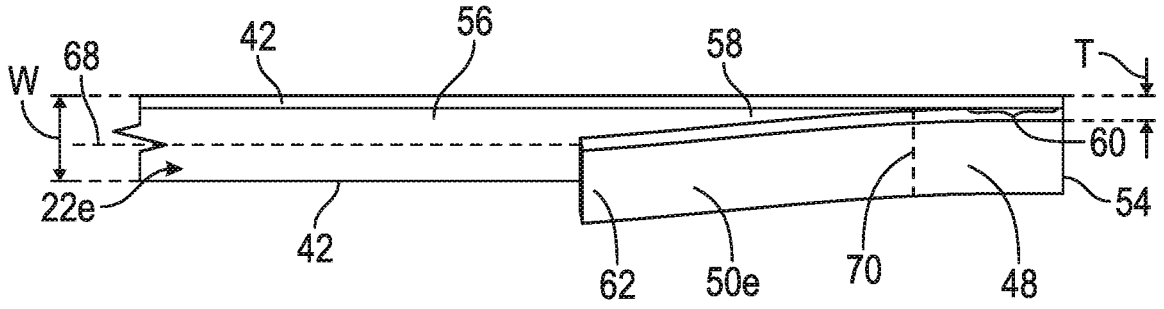
FIG. 13 is a partial front view of a fifth exemplary closure strip.

FIG. 13 shows a partial front view of a fifth exemplary closure strip 22*e* with a flap securing feature that is not formed of a cut of the closure strip 22*e*. Rather, in an exemplary embodiment, closure strip 22*e* is formed with a base 56 having a tab 50*e* attached to each end thereof to form a slot 58 into which the flap 32 of bag 20 is inserted. In an exemplary embodiment, base 56 and tab 50*e* are bonded together at bond zone 60, such as by the use of adhesive. In other embodiments, they can be integrally formed (such as by injection molding, for example) or fastened together by other means, as long as the tab 50*e* is biased by the material's structural memory to lie against the base 56, forming a slot 58 that tends to retain the flap 32 therein.

Figure 14:
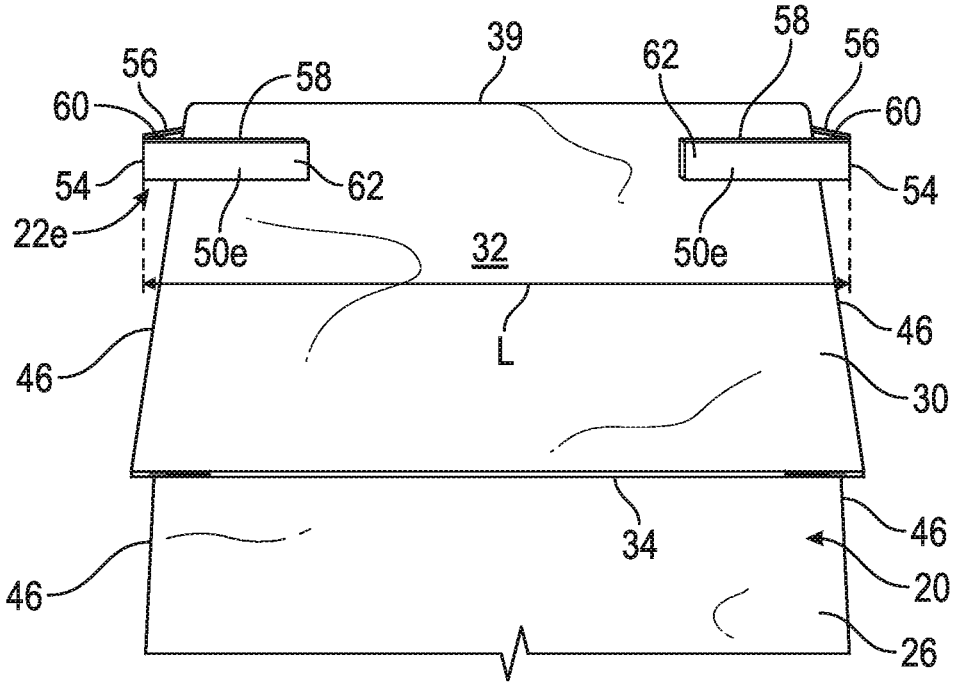
FIG. 14 is a partial front view of a bag closed by the closure strip of FIG. 13.

In an exemplary embodiment, an adhesive layer 36 (shown in FIG. 2A) is disposed along a portion of the length of the base 56. As shown in FIG. 14, flap 32 is retained in the folded configuration, with the fold along line 39. To obtain this closed configuration of bag 20 with closure strip 22*e*, a user slides each side edge 46 of flap 32 behind tab 50*e* (which is configured to be substantially parallel with base 56 of strip 22*e*), thereby retaining the flap 32 in the folded configuration within slots 58. Thus, the tabs 50*e* do not rely on the deadfold properties of wires as do conventional tin ties; rather, the closure strip 22*e* retains flap 32 due to inherent structural memory properties of the strip material. In exemplary embodiments, retaining tabs 50*e* of closure strip 22 extend over side edges 46 of flap 32 to hold the flap 32 against front panel 26.

Illustrative dimensions are hereby provided for exemplary article 22*e*. A suitable length L is at least about 0.5 inch (12.7 mm) greater than a parallel dimension bag 20 between the opposed side edges 46. For example, for a bag 20 that is 3.5 inches (89 mm) between opposed side edges 46, closure strip 22 suitably has a length L that is about 4.0 inches (102 mm). A suitable width W is about 0.31 inch (8 mm), with a preferred range of about 0.25 inch (6.4 mm) to about 0.50 inch (13 mm). A suitable thickness T is about 0.060 inch (1.52 mm), with a preferred range of about 0.030 inch (0.76 mm) to about 0.090 inch (2.3 mm), depending on a desired flap hold strength. Thickness T includes the thicknesses of both base 56 and tab 50*e* bonded together at bond zone 60; however, the base 56 and tab 50*e* can have different thicknesses and different material compositions. Base 56 and tab 50*e* can have flat or profiled major surfaces; for example, base 56 can have female profile structures that align with corresponding male profile structures of tab 50*e* at the bonding interface. A length of tab 50*e* that overlaps bag 20 is at least about 0.25 inch (6.4 mm) but not greater than about 1 inch (25.4 mm). A length of bond zone 60 is about 0.25 inch (6.4 mm), with a preferred range of about 0.125 inch (3.2 mm) to about 0.50 inch (13 mm). While tab 50*e* is illustrated with sharp corners at separating end 62, all corners on all features of strip 22 can be rounded or have another shape.

Resilient materials suitable for the formation of closure strip 22 include polymers, particularly those that are commercially recyclable. In an exemplary embodiment, each closure strip 22 is formed integrally as a single unit, particularly for the embodiments of strips 22*a*, 22*b*, 22*c*, 22*d*. Especially suitable materials have properties such as the following: tensile strength range of about 25 MPa to about 35 MPa; flexural modulus range of about 1200 MPa to about 1750 MPa; hardness of Shore D greater than about 60; and softening point greater than about 250 degree F. (121 Celsius). One suitable material is high density polyethylene commercially available from Nova Chemicals of Alberta, Canada as "SCLAIR 19A Resin Homopolymer HDPE Molding Resin." Another suitable material is high density polyethylene commercially available from M. Holland Company of Northbrook, Illinois as "MTEGRITY™ HDPE HD360."

Non-limiting, exemplary embodiments of an article, a method and an apparatus are described. In an exemplary embodiment, a reclosure article 22 is configured for permanent attachment to a flexible container 20, the article 22 including a resilient, elongated strip including first and second fasteners 50 proximate each of two opposed ends 54. In an exemplary embodiment, at least the first fastener 50 includes a slot 42, 44, 52, 58 configured to receive one of first and second opposite side edges 46 of the flexible container 20. In an exemplary embodiment, the slot includes a first cut 42, 44, 52 through the strip 22. In an exemplary embodiment as shown in FIGS. 1-5, for example, the strip 22 includes first and second opposed longitudinal edges 42, and the first cut 40 extends to one of the first and second longitudinal edges 42. In an exemplary embodiment, a second cut 44 extends to the first cut 40. In an exemplary embodiment, the first cut 40 and the second cut 44 are mutually orthogonal. In an exemplary embodiment as shown in FIGS. 13 and 14, for example, the slot 58 is configured as an unbonded portion between the strip 22 (at base 56) and a tab 50*e* that is partially bonded to the strip 22.

In an exemplary embodiment, the article includes an adhesive layer 36 disposed on the strip 22 between the first and second fasteners 50. In an exemplary embodiment, a release liner 38 is disposed on the adhesive layer 36. In exemplary embodiments shown in FIGS. 6-12, for example, the strip 22 comprises first and second opposed longitudinal edges 42, and wherein the first cut 52 is disposed entirely in an interior of the strip remote from both of the first and second longitudinal edges 42. In an exemplary embodiment, the first cut 52 is curved. In an exemplary embodiment, the first cut 52 is symmetrical about a longitudinal bisector 68 of the strip 22. In an exemplary embodiment as shown in FIGS. 11 and 12, for example, the strip includes a raised bead 64 disposed along at least one of the first and second longitudinal edges 42. In an exemplary embodiment, the first cut 52*d* is disposed through a portion of the raised bead 64.

An exemplary method of closing a flexible container 20 using a reclosure article 22 is described. An exemplary method includes inserting one of first and second opposite side edges 46 of the flexible container 20 into the slot 42, 44, 52, 58. In an exemplary embodiment, the strip 22 includes a base 56 defined between the first and second fasteners 50, a first tab 50 defined by the slot 42, 44, 52, 58, and a grip flap 48 defined between the first tab 50 and a first end 54 of the strip 22. An exemplary method includes flexing the strip 22 at the grip flap 48 to move the first tab 50 out of alignment with a plane of the base 56 (as shown in FIGS. 2A and 3, for example). Another exemplary method includes lifting an end 62 of the first tab 50 out of alignment with a plane of the base 56 (as discussed with reference to FIG. 9, for example). An exemplary method includes folding a portion of the container (such as at fold line 39) before inserting one of first and second opposite side edges 46 of the flexible container 20 into the slot 42, 44, 52, 58.

In an exemplary embodiment, an apparatus includes a flexible container 20 and a resilient, elongated strip 22 permanently attached to the flexible container 20. In an exemplary embodiment, an adhesive layer 36 is disposed between the flexible container 20 and the resilient, elongated strip 22. In an exemplary embodiment, the apparatus of claim is formed essentially of a polymeric composition.

Although the subject of this disclosure has been described with reference to several embodiments, workers skilled in the art will recognize that changes may be made in form and detail without departing from the scope of the disclosure. In addition, any feature disclosed with respect to one embodiment may be incorporated in another embodiment, and vice-versa.

The invention claimed is:

1. A reclosure article configured for permanent attachment to a flexible container, the article including a resilient, elongated strip comprising:
- first and second tabs proximate each of first and second opposed ends, respectively;
- first and second opposed longitudinal edges;
- a raised bead disposed along at least one of the first and second longitudinal edges; and
- a base extending between the first and second tabs and having a longitudinal center;
- wherein at least the first tab has:
  - a first position in which an end of the first tab toward the center contacts the base; and
  - a second position wherein the first tab is flexed open so that the end of the first tab toward the center is moved out of contact with the base; and
  - a slot that includes a first cut through the strip.

2. The article of claim 1, wherein the first cut extends to one of the first and second longitudinal edges.

3. The article of claim 2 including a second cut that extends to the first cut.

4. The article of claim 3, wherein the first cut and the second cut are mutually orthogonal.

5. The article of claim 1 including an adhesive layer disposed on the strip between the first and second tabs.

6. The article of claim 5 including a release liner disposed on the adhesive layer.

7. The article of claim 1, wherein the first cut is disposed entirely in an interior of the strip remote from both of the first and second longitudinal edges.

8. The article of claim 1, wherein the first cut is curved.

9. The article of claim 1, wherein the first cut is symmetrical about the longitudinal center.

10. The article of claim 1, wherein the first cut is disposed through a portion of the raised bead.

11. The article of claim 1 comprising a grip flap defined between the first tab and a first end of the strip.

12. A method of closing a flexible container using a reclosure article that is permanently attached to the container, the article comprising a resilient, elongated strip comprising:
- first and second opposed longitudinal edges;
- a raised bead disposed along at least one of the first and second longitudinal edges;
- first and second tabs at each of two opposed ends of a base having a longitudinal center, wherein at least the first tab comprises a slot cut through the strip; and
- a grip flap defined between the first tab and a first end of the strip;

the method comprising:
- flexing the strip at the grip flap to move the first tab; and
- inserting one of first and second opposite side edges of the flexible container into the slot.

13. The method of claim 12, comprising moving an end of the first tab out of alignment with a plane of the base.

14. The method of claim 12 including folding a portion of the container before inserting one of first and second opposite side edges of the flexible container into the slot.

15. An apparatus comprising:
- a flexible container having first and second opposite side edges; and
- a resilient, elongated strip permanently attached to the flexible container, the strip:
  - having a longitudinal center and first and second opposed longitudinal edges, wherein a raised bead is disposed along at least one of the first and second longitudinal edges; and
  - including first and second fasteners at each of two opposed ends of a base, wherein:
    - the first fastener comprises a first slot cut through the strip and configured to flex open toward the center, the first slot being positioned at the first side edge of the flexible container, and the second fastener comprises a second slot configured to flex open toward the center, the second slot being positioned at the second side edge of the flexible container.

16. The apparatus of claim 15 including an adhesive layer disposed between the flexible container and the resilient, elongated strip.

17. The apparatus of claim 15 formed essentially of a polymeric composition.

* * * * *